US006474060B2

(12) United States Patent
Khair

(10) Patent No.: US 6,474,060 B2
(45) Date of Patent: Nov. 5, 2002

(54) EXHAUST GAS RECIRCULATION FILTRATION SYSTEM

(75) Inventor: Magdi K. Khair, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 09/437,429

(22) Filed: Nov. 17, 1999

(65) Prior Publication Data

US 2001/0042372 A1 Nov. 22, 2001

(51) Int. Cl.[7] ..... F01N 3/00

(52) U.S. Cl. ..... 60/275; 60/278; 60/280; 60/311; 60/605.2

(58) Field of Search ..... 60/275, 278, 280, 60/295, 297, 311, 602.5, 605.2

(56) References Cited

U.S. PATENT DOCUMENTS

| | | | | | |
|---|---|---|---|---|---|
| 4,316,360 | A | | 2/1982 | Liu et al. | 60/275 |
| 4,338,784 | A | | 7/1982 | Liu et al. | 60/274 |
| 5,085,049 | A | * | 2/1992 | Rim et al. | 60/278 |
| 5,155,994 | A | * | 10/1992 | Muraki et al. | 60/278 |
| 5,425,239 | A | * | 6/1995 | Gobert | 60/605.2 |
| 5,426,936 | A | * | 6/1995 | Levendis et al. | 60/311 |
| 5,440,880 | A | | 8/1995 | Ceynow et al. | 60/605.2 |
| 5,443,547 | A | * | 8/1995 | Morikawa | 60/278 |
| 5,457,958 | A | | 10/1995 | Boegner et al. | 60/279 |
| 5,517,976 | A | | 5/1996 | Bächle et al. | 123/569 |
| 5,592,925 | A | | 1/1997 | Machida et al. | 123/568 |
| 5,611,203 | A | | 3/1997 | Henderson et al. | 60/605.2 |
| 5,671,600 | A | | 9/1997 | Pischinger et al. | 60/605.2 |
| 5,746,984 | A | | 5/1998 | Hoard | 422/169 |
| 5,771,868 | A | | 6/1998 | Khair | 123/570 |
| 5,785,030 | A | * | 7/1998 | Paas | 60/278 |
| 5,802,846 | A | | 9/1998 | Bailey | 60/278 |
| 5,806,308 | A | * | 9/1998 | Khair et al. | 60/278 |

(List continued on next page.)

FOREIGN PATENT DOCUMENTS

| | | | | |
|---|---|---|---|---|
| DE | 2234181 | * | 1/1973 | 60/278 |
| DE | 2730769 | * | 1/1978 | 60/280 |
| DE | 19808098 | | 8/1999 | B01D/53/92 |
| DE | 19826831 | | 10/1999 | F01N/3/08 |
| EP | 341832 | | 11/1989 | F01N/3/02 |
| JP | 63189664 | | 8/1988 | F02M/25/06 |
| JP | 08338320 | | 12/1996 | F02M/25/07 |
| JP | 09088727 | | 3/1997 | F02M/25/07 |
| WO | 092020911 | * | 11/1992 | 60/280 |
| WO | WO 99/09307 | | 2/1999 | F01N/3/02 |
| WO | 0021646 | | 4/2000 | B01D/53/32 |

OTHER PUBLICATIONS

PCT Search Report PCT/US00/41311, Mar. 30, 2001.

Akira Mizuno, "Reactive Absorption of $NO_x$ Using Wet Discharge Plasma Reactor", IEEE Transactions on Industry Applications, vol. 31, No. 6, pp. 1463–1468, Nov. 1, 1995.

Anonymous, "CRT Filter", Internet Article, XP–002162969, Retreived from Internet<URL:http://www.dieselnet.com/tech/dpt$_{13}$ crt.html>, Mar. 15, 2001.

Written Opinion from PCT/US00/41311.

*Primary Examiner*—Thomas Denion
*Assistant Examiner*—Diem Tran
(74) *Attorney, Agent, or Firm*—Baker Botts L.L.P.

(57) ABSTRACT

A filtration system adapted to prevent diesel soot carried with recirculated exhaust gas from being recirculated through internal combustion engine. The filtration system provides continuous elimination of soot, thus reducing its negative impact on engine life, lubrication oil quality, and on components in the exhaust gas recirculation system. The filtration system comprises a non-thermal plasma generator that periodically, or continuously, oxidizes carbon deposited, or trapped, within a carbon filter disposed downstream of the non-thermal plasma generator.

7 Claims, 1 Drawing Sheet

U.S. PATENT DOCUMENTS 5,891,409 A 4/1999 Hsiao et al. ..... 423/239.1
5,904,905 A 5/1999 Dolezal et al. ..... 422/186.04
5,937,651 A 8/1999 Braun et al. ..... 60/605.2
5,950,420 A * 9/1999 Geiger ..... 60/278
5,980,610 A 11/1999 Huang et al. ..... 95/58
6,003,315 A * 12/1999 Bailey ..... 60/602.5
6,012,283 A * 1/2000 Miller et al. ..... 60/275
6,038,854 A * 3/2000 Penetrante et al. ..... 60/297
6,038,860 A * 3/2000 Bailey ..... 60/605.2
6,092,512 A * 7/2000 Ma ..... 123/568.15
6,209,530 B1 * 4/2001 Faletti et al. ..... 60/602.5
6,216,458 B1 * 4/2001 Alger et al. ..... 60/605.2

* cited by examiner

EXHAUST GAS RECIRCULATION FILTRATION SYSTEM

BACKGROUND OF THE INVENTION

1. Technical Field

This invention relates generally to a filtration system for an exhaust gas recirculation system, and more particularly to such a filtration system having separate electrochemical and particulate filter stages.

2. Background Art

Increasingly stringent emission regulations call for a major reduction in $NO_x$ emissions. Engine manufacturers have developed systems for exhaust gas recirculation (EGR) to achieve lower NOx standards. Using EGR in diesel engines has real advantages at low engine load conditions where high air/fuel (A/F) ratios are dominant. At high engine load conditions, A/F ratios are greatly reduced and may reach values as low as 20:1. Low A/F ratios contribute to excessive smoke formation. Recirculating exhaust gas with high soot content, whether at high or low A/F conditions, has adverse consequences on engine durability, lubrication oil quality, and on the service life of exhaust gas recirculation system components.

Exhaust gases carry a number of chemical constituents that result from the combustion process. These constituents normally include; unburned hydrocarbons, carbon monoxide, carbon dioxide, and nitrogen oxides, along with other gases. Most, generally about 90%, of nitrogen oxides emitted from diesel combustion are in the form of nitric oxide (NO).

In high pressure loop exhaust gas recirculation systems, i.e., EGR systems for turbocharged engines with the exhaust gas recirculated directly between the exhaust and intake manifolds, all components of the EGR system, such as heat exchangers and control valves, are subjected to exhaust gas containing all of the untreated products of combustion. The untreated exhaust gas shortens the service life of the EGR system, necessitating frequent cleaning of the heat exchanger surfaces to prevent fouling, or even closure of the gas flow path through the exchanger, as well as frequent cleaning of the EGR flow control valve to prevent fouling which would avoid proper operation of the valve.

Previous attempts at reducing undesirable products of combustion from exhaust gas in turbocharged engines have primarily been directed to treating the exhaust gas downstream of the turbocharger, with the treated recirculated exhaust gas being introduced upstream of the compressor stage of the turbocharger. For example, PCT International Application No. WO 99/09307, published Feb. 25, 1999, describes a low pressure loop exhaust gas recirculation system incorporating a catalyst and a particulate trap disposed in the undivided exhaust stream downstream of the turbocharger.

Other emission reduction systems have also been directed at reducing $NO_x$ and hydrocarbon emissions from the overall exhaust gas discharged from an engine. An exhaust gas treatment system comprising a storage device for collecting $NO_x$ hydrocarbon, or particulate emissions, and a plasma reactor for destroying the collected emissions, is described in U.S. Pat. No. 5,746,984, issued May 5, 1998, to John W. Hoard and entitled EXHAUST SYSTEM WITH EMISSIONS STORAGE DEVICE AND PLASMA REACTOR. Neither of the above described exhaust gas treatment systems have effectively addressed the problem of specifically treating exhaust gas recirculated through a high pressure loop EGR system.

The present invention is directed to overcoming the problems set forth above. It is desirable to have a filtration system for a high pressure loop exhaust gas recirculation system in which the filtration system reduces particulate matter and other deleterious products of combustion circulated through components of the EGR system. It is also desirable to have such a filtration system which not only traps particulate matter from the high pressure circulated gas stream, but also has the means for removing the trapped particulate matter from the filter. Furthermore, it is also desirable to have an EGR filtration system that interacts with the gas molecules in the exhaust gas stream, and thereby creates free radicals in the recirculated exhaust gas stream that have a longer life and thereby enhance combustion of fuel mixed with the recirculated exhaust gas.

SUMMARY OF THE INVENTION

In accordance with one aspect of the present invention, an exhaust gas recirculation filtration system for an internal combustion engine having an intake manifold and exhaust manifold in direct fluid communication with at least one combustion chamber of the engine includes a non-thermal plasma generator having an intake port in direct fluid communication with the exhaust manifold of the engine, and an exhaust portion spaced from the intake port. The filtration system also includes a particulate filter having an intake port in direct fluid communication with the exhaust port of the non-thermal plasma generator and an exhaust port spaced from the intake portion. The exhaust port of the particulate filter is in controlled fluid communication with the intake manifold of the engine.

Other features of the exhaust gas recirculation filtration system embodying the present invention include the filtration system being one component of an exhaust gas recirculation system having a flow control valve interposed between the exhaust port of the particulate filter of the filtration system and the intake manifold of the engine. Other features include the exhaust gas recirculation system having a heat exchanger interposed between the exhaust port of the particulate filter of the filtration system and the flow control valve.

Still other features of the exhaust gas recirculation filtration system embodying the present invention include the non-thermal plasma generator being a pulsed corona discharge device providing high voltage pulses in a range of from about 30 kv to about 40 kv, each having a width of from about 5 ns to about 10 ns at a frequency of about 100 Hz. Still additional features include the internal combustion engine being a turbocharged engine having a compressor stage disposed between an air intake duct and the intake manifold and mechanically driven by a turbine stage disposed between the exhaust manifold and an exhaust duct of the engine. In this embodiment, the exhaust gas recirculation system embodying the present invention is disposed between the exhaust manifold and the intake manifold of the engine, thus forming a high pressure loop exhaust gas recirculation system for the engine.

BRIEF DESCRIPTION OF THE DRAWING

A more complete understanding of the structure and operation of the present invention may be had by reference to the following detailed description when taken in conjunction with the accompanying drawings, wherein.

DETAILED DESCRIPTION OF A PRESENTLY PREFERRED EXEMPLARY EMBODIMENT

Figure 1:
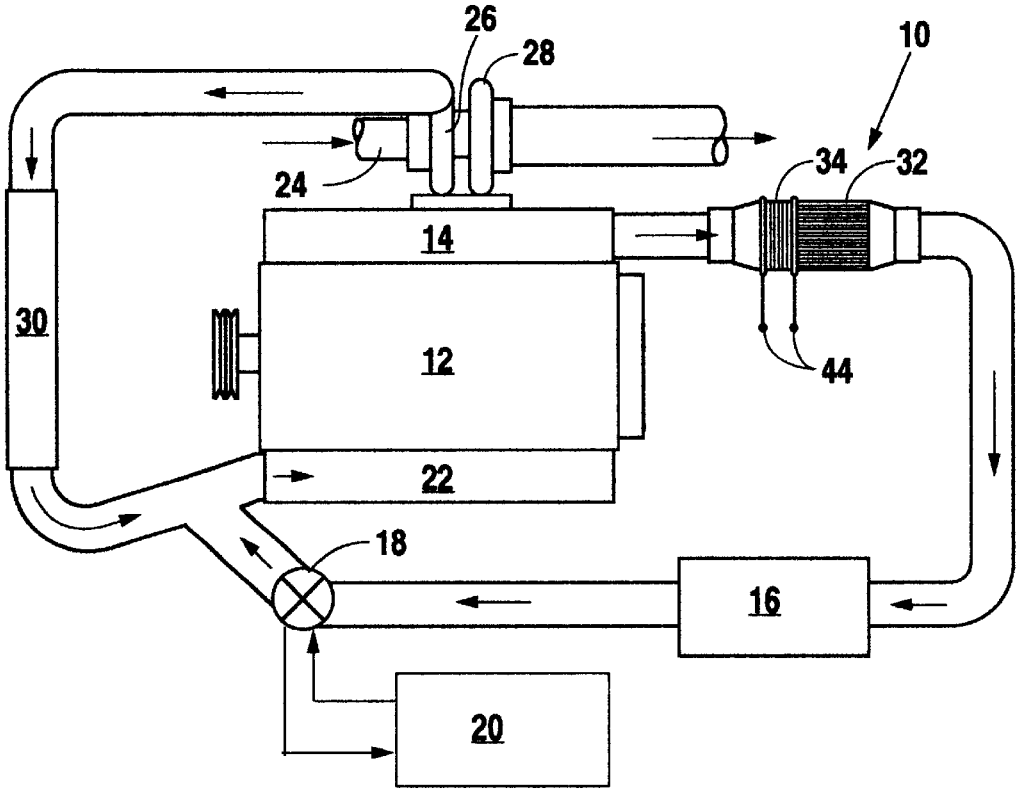
FIG. 1 is a schematic representation of a turbocharged engine having an exhaust gas recirculation filtration system embodying the present invention.

In the preferred embodiment of the present invention, an exhaust gas recirculation filtration system is generally indicated in the drawings by the reference numeral 10. In the illustrative preferred embodiment, the EGR filtration system 10 is incorporated in a high pressure loop exhaust gas recirculation system of a turbocharged diesel engine 12, as illustrated in FIG. 1. The direction of flow of exhaust gas into, out of, and through the high pressure loop is indicated by directional arrows in FIG. 1. Exhaust gas discharged from an exhaust manifold 14 is directed through the EGR filtration system 10 embodying the present invention, where soot and other carbonaceous matter is retained and treated as described below in greater detail. Filtered exhaust gas then flows through an exhaust gas recirculation cooler, or heat exchanger 16, preferably using engine jacket water as its cooling medium. Once cooled, the recirculated exhaust gas flows to an electronically controlled EGR valve 18. Valve operation is controlled by an electronic control module (ECM) 20, which typically is incorporated within the engine electronic control module. Filtered, cooled, and rate-controlled recirculated exhaust gas then flows to the engine's intake manifold 22 where it is entrained and mixed with fresh air supplied by an intake duct 24, compressed by a compressor stage 26 that is mechanically driven by an exhaust gas turbine stage 28. Desirably, the compressed air discharged from the compressor stage 26 is cooled through an air-to-air intercooler 30 positioned between the compressor stage 26 and the intake manifold 22 of the engine.

Figure 2:
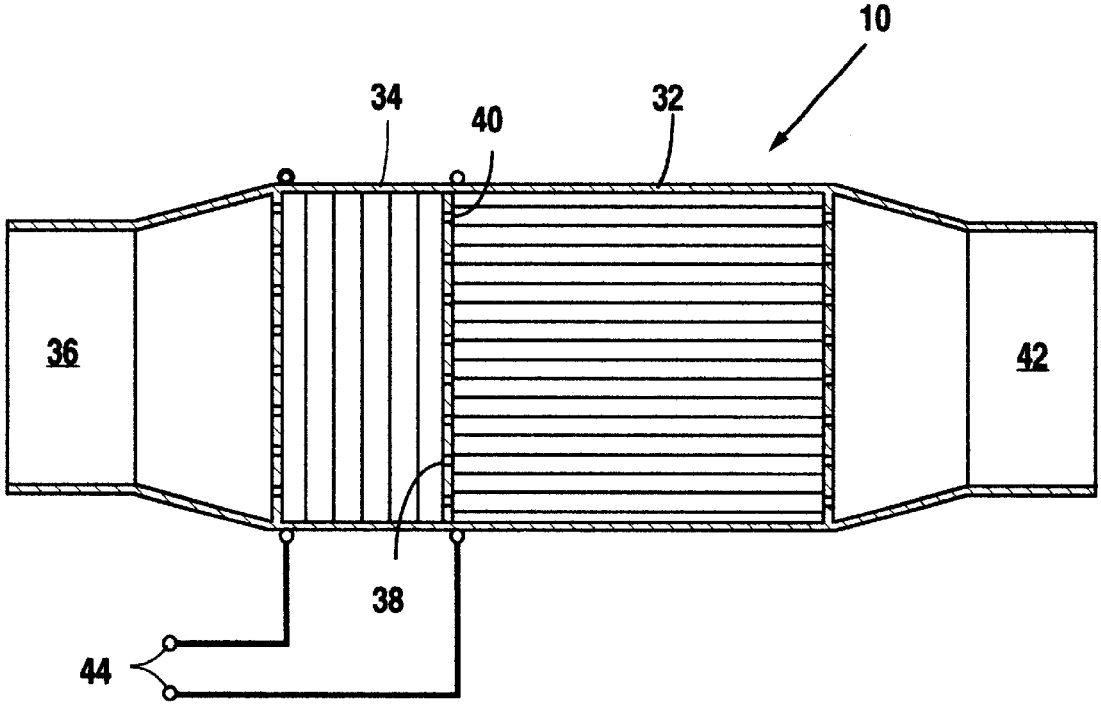
FIG. 2 is a schematic representation of the exhaust gas recirculation filtration system embodying the present invention.

With specific reference to FIG. 2, the exhaust gas recirculation filtration system 10 embodying the present invention comprises a particulate filter 32 and a non-thermal plasma generator 34. The particulate filter 32 may have a construction of wire mesh, sintered metal, ceramic or metal foams, silicon carbide, or other filter material or form. Particulate matter, consisting mainly of soot or carbonaceous material, is trapped in the particulate filter 32 and clean recirculated exhaust gas is discharged to the EGR cooler 16, and subsequently through the EGR control valve 18 prior to being introduced into the intake manifold 22 of the engine 12.

If particulate matter is allowed to accumulate in the particulate filter, or trap, 32, the accumulation would eventually be sufficient to block further exhaust gas from flowing through the filtration system 10. Thus, the particulate filter, or trap, 32 is periodically, or preferably continuously, cleaned by the non-thermal generator 34 positioned upstream of the particulate filter 32. More specifically, the non-thermal plasma generator 34 has an intake port 36 that is in direct fluid communication with the exhaust manifold 14 of the engine 12, and an exhaust port 38 spaced from the intake port 36. The particulate filter 32 has an intake port 40 in direct fluid communication with the exhaust port 38 of the non-thermal plasma generator and an exhaust port 42 spaced from the intake port 40, the exhaust port 42 being in controlled fluid communication with the intake manifold 22 of the engine 12.

The non-thermal plasma generator 34 receives power from a power supply source 44, such as the vehicle's electrical system. Energy from the power supply 44 is stored in an electrical energy storage unit and dispensed through a fast-acting switch to the non-thermal plasma generator 34 in the form of high voltage pulses in the order of from about 30 kv to about 40 kv, each having a width of from about 5 to about 10 nanoseconds at a frequency of about 100 Hz. The non-thermal plasma generator 34, is desirably a pulsed corona-type reactor, as described in the above-discussed U.S. Pat. No. 5,746,984, and is sized appropriately for the maximum EGR flow rate of the exhaust gas recirculation system of the engine 12. Other examples of suitable non-thermal plasma generators include low discharge, RF discharge, silent discharge, dielectric/barrier discharge, electrified packed bed, and surface discharge devices, examples of which are also illustrated in U.S. Pat. No. 5,746,984. Another type of non-thermal plasma device is described in U.S. Pat. No. 5,904,905 issued May 18, 1999 to Franklin A. Dolezal, et al.

The exhaust gas discharged from the combustion chambers of the engine 12, through the exhaust manifold 14, carry certain chemical components that result from the combustion process. As discussed earlier, these components normally include; unburned hydrocarbons, carbon monoxide, carbon dioxide, and nitrogen oxides along with other chemical compounds. Most (generally about 90%) of the nitrogen oxides emitted from a diesel engine are in the form of nitric oxide (NO). As the NO gas flows through the non-thermal plasma generator 34, it is converted to nitrogen dioxide ($NO_2$). Nitrogen dioxide formed in the non-thermal plasma generator reacts with soot, primarily carbon, that may have accumulated in the particulate filter 32, and forms carbon dioxide ($CO_2$) and nitrogen ($N_2$), two gases that flow through porous particulate filter walls. Removal of the carbon soot thus keeps the filter continuously clean.

An additional significant benefit of the exhaust gas filtration system 10 embodying the present invention is attributable to its placement in close proximity, i.e., prior to the turbine stage 28 of the turbocharger, with the exhaust manifold 14. Because of the close proximity of the filtration system 10 to the exhaust manifold 14, the recirculated exhaust gas not only has a high elevated temperature, but also high pressure. Operation of the non-thermal plasma generator 14 produces highly excited electrons that interact with gas molecules, thus creating radicals. These radicals have longer life and are highly energized, thus improving combustion upon being reintroduced into the combustion chamber of the engine 12. In addition to the non-thermal plasma generator's role in aiding oxidation of carbon to carbon monoxide, diesel exhaust is generally rich in oxygen. With the abundance of oxygen and in the presence of high temperatures attributable to a close proximity to the exhaust manifold, carbon oxidation is further enhanced.

Thus, the exhaust gas recirculation filtration system 10 embodying the present invention advantageously provides a filtration system for exhaust gas recirculation system which prevents diesel soot carried within the recirculated exhaust gas from being recirculated through the engine 12. Importantly, the EGR filtration system 10 provides for the continuous elimination of soot in the recirculated exhaust gas, thus reducing the negative impact of soot on engine life, lube oil quality, and the propensity for fouling of other components of the EGR system, such as the heat exchanger 16 or the EGR control valve 18.

Additionally, the EGR filtration system 10 embodying the present invention provides a number of important advantages not provided heretofore in other exhaust gas recirculation systems. The EGR filtration system 10 oxidizes carbon, thus producing carbon dioxide which is a gas with high heat absorbing capacity. Increasing carbon dioxide content in the recirculated exhaust gas improves the recirculated exhaust gas capability for further reducing $NO_x$ emissions in the exhaust gas emitted to the atmosphere. Cleaning the recirculated exhaust gas prior to flowing through the cooler, or heat exchanger, 16 helps maintain the cooler's heat transfer effectiveness by keeping it free from fouling. In similar manner, cleaning the exhaust gas prior to flowing through the EGR control valve 18 helps protect the valve 18 from fouling and maintains the valve's trouble-free function over prolonged periods of operation. Also, by introducing highly ionized radicals in the recirculated exhaust gas, combustion of fuel in the engine is enhanced.

Although the present invention is described in terms of a preferred exemplary embodiment, those skilled in the art will recognize that changes in the illustrated embodiment may be made without departing from the spirit of the invention. Such changes are intended to fall within the scope of the following claims. Other aspects, features, and advantages of the present invention may be obtained from a study of this disclosure and the drawings, along with the appended claims.

ELEMENT LIST

EGR filtration system
engine
exhaust manifold
EGR cooler
EGR valve
ECM
intake manifold
air intake duct
compressor stage
turbine stage
air-to-air intercooler
particulate filter
non-thermal plasma generator
intake port (of 34)
exhaust port (of 34)
intake port (of 32 )
exhaust port (of 32)
power supply source

What I claim is:

1. A high pressure loop exhaust gas recirculation system for internal combustion engines having an intake manifold and two-port exhaust manifold in direct fluid communication with at least one combustion chamber of said engine, and having a turbocharger system for turbocharging the engine, said filtration system comprising:

an intake conduit connected directly to the exhaust manifold and dedicated exclusively to the flow of exhaust for EGR purposes;

a non-thermal plasma generator that receives exhaust from the intake conduit, wherein said non-thermal plasma generator is a pulsed corona discharge device operating in a range from 30 kv to 40 kv;

a particulate filter in direct fluid communication with the plasma generator and that receives treated exhaust from the plasma generator; wherein the plasma generator is used to clean the particulate filter;

an output conduit connected to the turbocharger system, such that the turbocharger system and the output conduit share a common port into the intake manifold; and a valve disposed between the particulate filter and the output conduit, the valve operable to immediately control the amount of treated exhaust entering the intake manifold.

2. The high pressure loop exhaust gas recirculation system, as set forth in claim 1, further comprising a cooler interposed between the exhaust port of the particulate filter of the filtration system and the valve.

3. The high pressure loop exhaust gas recirculation system, as set forth in claim 2, wherein cooler is a heat exchanger.

4. The high pressure loop exhaust gas recirculation system, as set forth in claim 3, wherein said non-thermal plasma generator is a pulsed corona discharge device operating at a pulse width from 5 ns to 10 ns at about 100 Hz.

5. The high pressure loop exhaust gas recirculation system, as set forth in claim 1, wherein said internal combustion engine is a turbocharged engine having a compressor stage disposed between an air intake duct and said intake manifold, said compressor stage being mechanically driven by a turbine stage disposed between said exhaust manifold and an exhaust duct of said engine, said exhaust gas recirculation system being disposed between the exhaust manifold and the intake manifold of the engine.

6. A method of providing a high pressure loop exhaust gas recirculation system for internal combustion engines having an intake manifold and two-port exhaust manifold in direct fluid communication with at least one combustion chamber of said engine, and having a turbocharger system for turbocharging the engine, said method comprising the steps of:

receiving exhaust from the engine exhaust manifold, via an intake conduit connected directly to the exhaust manifold and dedicated exclusively to the flow of exhaust for EGR purposes;

passing the exhaust through a non-thermal plasma generator that receives exhaust from the intake conduit, wherein said non-thermal plasma generator is a pulsed corona discharge device operating in a range from 30 kv to 40 kv;

filtering the output of the plasma generator through a particulate filter in direct fluid communication with the plasma generator; cleaning the particulate filter using the plasma generator;

returning the output of the filter to the intake manifold via an output conduit connected to the turbocharger system, such that the turbocharger system and the output conduit share a common port into the intake manifold; and using a valve disposed between the particulate filter and the output conduit to control the amount of treated exhaust entering the intake manifold.

7. The method of claim 6, wherein said non-thermal plasma generator operates at a pulse width from 5 ns to 10 ns at about 100 Hz.

* * * * *